United States Patent [19]

Cruzan

[11] 3,942,446

[45] Mar. 9, 1976

[54] OPTICAL FUZE AND/OR MISS DISTANCE INDICATOR

[75] Inventor: Orval R. Cruzan, Washington, D.C.

[73] Assignee: The United States of America as represented by the Secretary of the Army, Washington, D.C.

[22] Filed: Sept. 6, 1974

[21] Appl. No.: 503,998

[52] U.S. Cl. ..... 102/70.2 P
[51] Int. Cl.[2] ..... F42C 13/02
[58] Field of Search ..... 102/70.2 P; 343/7 PF

[56] References Cited

UNITED STATES PATENTS

| | | | |
|---|---|---|---|
| 2,892,093 | 6/1959 | Henderson | 102/70.2 P |
| 3,046,892 | 7/1962 | Cosse et al. | 102/70.2 P |
| 3,113,305 | 12/1963 | Trounson et al. | 102/70.2 P |
| 3,242,339 | 3/1966 | Lee | 102/70.2 P |

*Primary Examiner*—Charles T. Jordan
*Attorney, Agent, or Firm*—Nathan Edelberg; Robert P. Gibson; Saul Elbaum

[57] ABSTRACT

An optical miss distance detector and/or fuzing device for a missle. Four optical ring sensors are disposed around the missile body and the active sensing regions of the first and second sensors are disposed at an angle of 90° to the missile axis thereby forming first and second cones of 90° with respect to the axis while the active sensing regions of the third and fourth sensors are disposed at an angle of other than 90° to the axis thereby forming cones of other than 90° with respect to the axis. The third and fourth sensors are positioned along the axis so that the apices of the third and fourth cones coincide respectively with the apices of the first and second cones. The miss distance and relative velocity of the missile and the target are determined based on the times of interception of the cones and the azimuthal angles of interception. A fuzing arrangement is connected to the sensors which generates a detonation signal responsive to a predetermined order of interception of the cones indicating that the target is crossing the missile within a predetermined range.

6 Claims, 3 Drawing Figures

OPTICAL FUZE AND/OR MISS DISTANCE INDICATOR

RIGHTS OF THE GOVERNMENT

The invention described herein may be manufactured, used, and licensed by or for the United States Government for governmental purposes without the payment to me of any royalty thereon.

The present invention relates to an improved optical detection configuration for a missile and comprises an optical miss distance detector and/or fuzing device. The invention may be utilized solely as a miss distance detector, solely as a fuzing device, or as both depending on the specific electronics utilized therewith.

It is advantageous to provide an optical configuration which can be utilized both as a miss distance detector and as a fuze, separate optical components for each function therefore not being necessary. Additionally the fuze of the invention has desirable countercountermeasure characteristics and has the property of not being triggered even though the target passes by the missile if the target is not within a predetermined distance which distance may be controlled by changing the angle of the optical sensors.

It is thus an object of the invention to provide an improved optical miss distance detector and/or fuzing device for a missile.

It is a further object of the invention to provide a fuze for a missile which is activated only when the target passes within a predetermined maximum distance of the missile.

The above objects are accomplished by mounting an optical configuration comprised of four optical ring sensors on the missile body. The ring sensors are located at different longitudinal positions on the missile body and are positioned so that the active sensing regions of the sensors observe in the general case four conical directions. In the preferred embodiment the active sensing regions of the first and second ring sensors are disposed at an angle of 90° to the missile axis thereby forming first and second cones of 90° with respect to the axis having respective apices at first and second points on the axis and the active sensing regions of the third and fourth sensors are disposed at an angle of other than 90° to the missile axis thereby forming the third and fourth cones of other than 90° with respect to the axis. The third and fourth sensors are positioned along the axis so that the apices of the third and fourth cones coincide respectively with the first and second apices.

To determine the miss distance, information regarding the times of interception of the four cones by the target, and in some cases the azimuthal angles of interception of the cones are transmitted to a station at earth where appropriate formulae are solved to determine both the miss distance and the relative velocity between the missile and the target.

Further, electronics may be provided on the missile for utilizing the optical detector as a fuze having improved countercountermeasures properties. The fuze is arranged not to detonate until all four cones have been intercepted by the target. Additionally the order of interception is detected and means for producing a detonation signal responsive to a first predetermined order of interception which indicates that the target is within a predetermined distance of the missile is provided.

The invention will be better understood by referring to the drawings in which.

Figure 1:
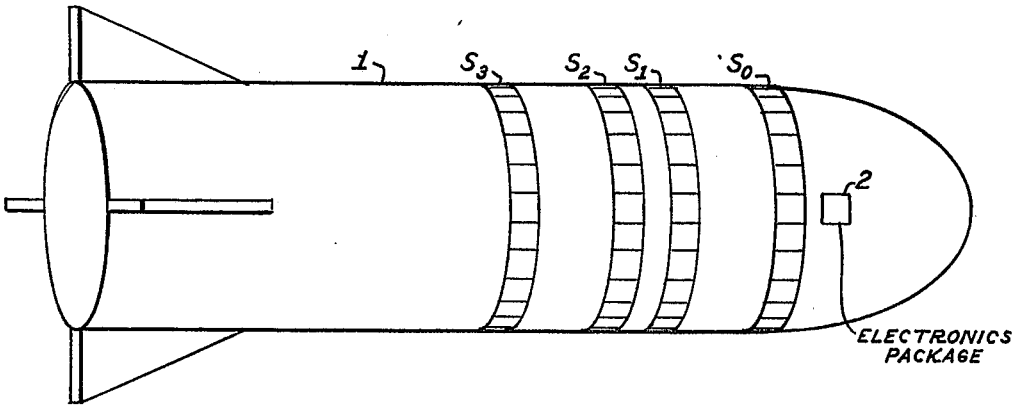
FIG. 1 is a schematic illustration of a missile having the improved optical detection configuration of the invention mounted thereon.

Referring to FIG. 1, missile 1 may be a defensive missile whose mission would be to destroy an enemy offensive missile towards which it would be guided. If missile 1 missed its target then it is useful to controllers on the ground to know the distance by which the target was missed as well as the relative velocity of the missile and target at passing and it is towards these goals which the optical miss distance detector is directed. If missile 1 does arrive close enough to the target then it is necessary for the missile to detonate to destroy the target and it is towards this goal which the fuzing arrangement of the invention is directed. Ring optical sensors $S_0$, $S_1$, $S_2$ and $S_3$ are disposed around the periphery of the missile body as shown in FIG. 1 and it is the unique configuration and relative arrangement of these ring sensors which enables them to be used either as a miss distance detector or as a fuze or as both depending on the specific electronics which are adopted for use therewith. In FIG. 1 electronics package 2 would contain the appropriate electronic components.

While ring optical sensors $S_0$, $S_1$, $S_2$ and $S_3$ are shown in FIG. 1 as being segmented (that is a plurality of discrete sensors in a ring configuration), as will be described below in certain embodiments of the miss distance detector yet if the system is to be used only as a fuze a ring sensor having a continuous unsegmented optical sensing region may be used. As known to those skilled in the art, the optical sensors may be either visible or infrared responsive and a wide variety of specific sensors utilizing specific radiant sensitive materials may be employed.

Figure 2:
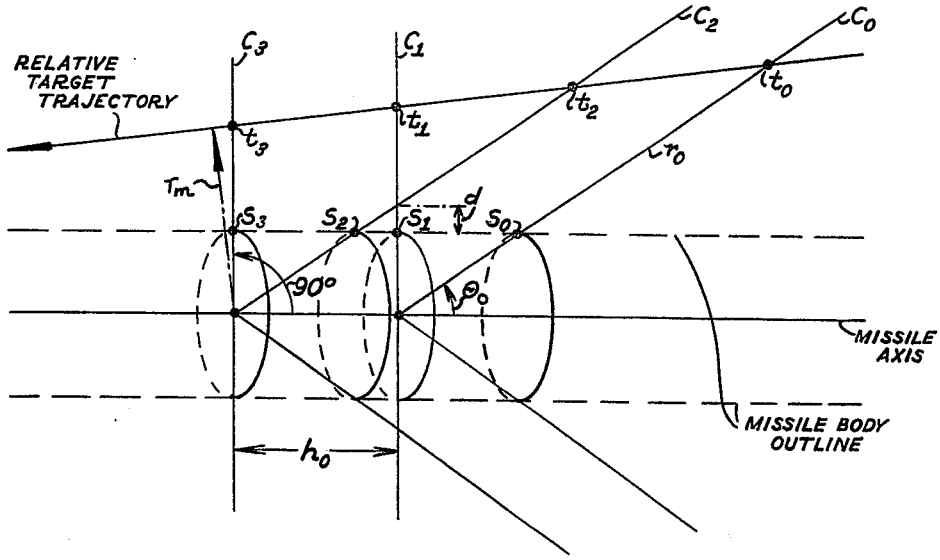
FIG. 2 is a detailed diagram of the optical relationships of the detection configuration.

The operation of the invention will be described in conjunction with FIG. 2. In FIG. 2 it is seen that ring sensors $S_1$ and $S_3$ are separated by a distance $h_0$. The active radiant sensing region of ring sensor $S_3$ and the active radiant sensing region of ring sensor $S_1$ face in a direction which is perpendicular to the direction of the missile axis and define respectively cones $C_3$ and $C_1$. The ring sensors $S_0$ and $S_2$ each have their active radiant sensing region disposed at an angle of $\theta_0$ with respect to the missile axis thereby forming cones $C_2$ and $C_0$. While this is not specifically shown in the general diagram of FIG. 1 the active sensing areas may be fixed at an angle other than 90° to the missile axis by any convenient mechanical means. Ring sensors $S_2$ and $S_0$ are positioned along the longitudinal axis of the missile body so that the apices of cones $C_2$ and $C_0$ coincide respectively with the apices of cones $C_3$ and $C_1$. While in the preferred embodiment of the invention four separate ring sensors are used, by a suitable arrangement of optics, sensors $S_3$ and $S_2$ can be combined as well as sensors $S_1$ and $S_0$.

IN FIG. 2, $t_0$, $t_2$, $t_1$ *and* $t_3$ indicate the respective times that the target intercepts cones $C_0$, $C_2$, $C_1$ and $C_3$. These times of intercept are transmitted by telemetry equipment contained in electronics package 2 to a ground station. Also information representative of the angles $\phi_0$ and $\phi_2$ which are the azimuthal angles at which the target crosses cones $C_0$ and $C_2$ respectively are transmitted to the ground station. These azimuthal crossing angles are the angles at which the target intercepts the cones measured in a plane perpendicular to the axis of the missile by a coordinate which is perpendicular to the missile axis in that plane. The segmented optical sensors can be used to detect the azimuthal crossing angles in a specific electronic circuit arrangement which will be apparent to one skilled in the art. That is a specific segmented sensing area around the ring will detect the interception of the target with the cone and information representative of the identity of that sensing area is radioed back to earth. For instance, detection of the target by each different segmented sensing area may cause a different modulation to be impressed on the signal emitted by the telemetering transmitter. If desired it is not necessary to utilize the azimuthal crossing angles in the calculations of miss distance and relative velocity and in this case $\phi_0$ and $\phi_2$ in the formulae below are set equal to 0 but if this arrangement is used the crossing angle of the target and the missile must be restricted to less than 30° and the results will be somewhat less accurate. In FIG. 2 the distances $r_0$ and $r_m$ are measured from the missile axis.

Thus, in the operation of the device, signals indicative of the times $t_0$, $t_2$, $t_1$ and $t_3$ and possibly the angles $\phi_0$ and $\phi_2$ are radioed to a ground station and the formulae below are solved for the miss distance $r_m$ and the relative velocity $V_R$. The distance $h_0$ is known and $\theta$ and $\phi$ are the angular spherical coordinates of the relative target trajectory while $r_0$ is the range at which the target interceps cone $C_0$.

Mathematical techniques for the solution of the formulas are known to those skilled in the mathematical arts and if desired the formulas may be solved by programming a general purpose digital computer.

$$V_R = -h_o/(t_3 - t_1) \cos \theta$$

$$r^2_m = B^2 + r_o^2 + h_o^2 + 2r_o h_o \cos \theta_o$$

where $$r_o = h_o(t_1 - t_o)/(t_3 - t_1) \cos \theta_o$$

$$\phi = \tan^{-1} \left[ \frac{(t_3 - t_2) \sin \phi_2 - (t_1 - t_0) \sin \phi_0}{(t_3 - t_2) \cos \phi_2 - (t_1 - t_0) \cos \phi_0} \right]$$

$$\theta = \tan^{-1} \left\{ \frac{-[(t_3 - t_2) \sin \phi_2 - (t_1 - t_0) \sin \phi_0] \tan \phi_0}{(t_2 - t_0) \sin \phi} \right\}$$

$$B - -h_o \cos \theta - r_o \cos \alpha$$

$$\cos \alpha = \cos \theta \cos \theta_o + \sin \theta \sin \theta_o \cos (\phi - \phi_o).$$

When the arrangement of the invention is used only as a fuze then the computation above may be dispensed with and the fuze is arranged to give a command to detonate after the last observation cone has been intercepted plus a given time delay. The advantage of utilizing four observation cones instead of a lesser number is that the four cone device has inherent countercountermeasure abilities which operate against the sun as well as a distant artificial source of radiation. The electronics is arranged so that if the fuze observes signals simultaneously in cones $C_1$ and $C_3$, or $C_0$ and $C_2$ no detonation command is given.

Figure 3:
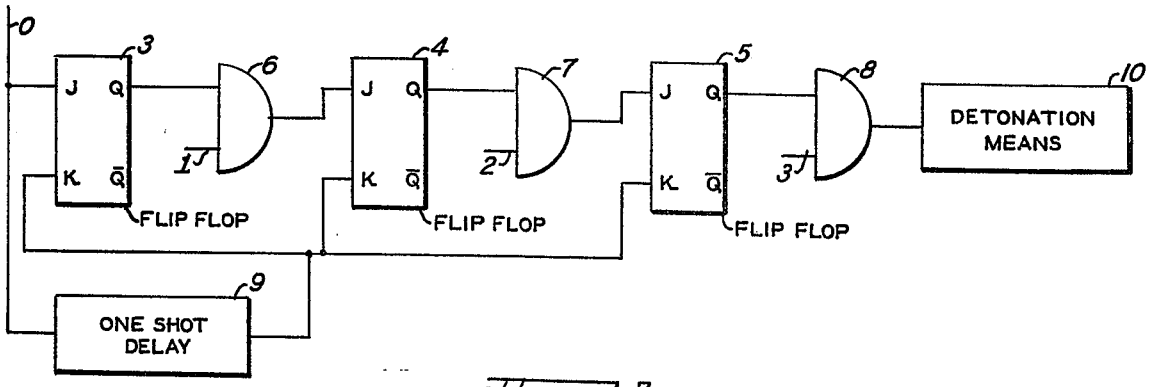
FIG. 3 is a schematic diagram of an electrical fuzing circuit which can be utilized with the invention.

The electronics arrangement in FIG. 3 is operative to attain the above advantages and additionally to insure that detonation occurs only when the target passes the missile within a predetermined range. Referring to FIG. 2 it is noted that the interception order of the cones beyond the distance d from the missile body is $t_0$, $t_2$, $t_1$ and $t_3$ while nearer than the distance d the order of interception is $t_0$, $t_1$, $t_2$ and $t_3$. If the fuze is arranged to detonate only when this latter order of times of occurrence is detected then the fuze will cause detonation only when the target is within a distance *d* of the missile. This distance can be varied by changing the angle $\theta_0$ in FIG. 2.

FIG. 3 shows an electronic circuit for causing activation of the fuze response to the $t_0$, $t_1$, $t_2$ and $t_3$ order of intercepting the cones. The output of ring sensor $S_0$ is fed to the J input of flip-flop 3, and the outputs of sensors $S_1$, $S_2$ and $S_3$ are fed respectively to AND gates 6, 7 and 8. If the invention is used solely as a fuze then continuous as opposed to segmented ring sensors may be used and if segmented sensors are used then all of the segments of a given ring would be connected to an OR gate and the output of each of the four OR gates would be connected to one of the inputs 0, 1, 2, and 3 in FIG. 3.

In the operation of FIG. 3 when the $C_0$ cone is intercepted a signal appears at input J of flip-flop 3 thereby causing output Q to go high. If the next signal to occur is the interception of cone $C_1$ then a signal will appear at input 1 of AND gate 6 thus causing the output of that gate to go high which in turn sets flip-flop 4 and causes the Q output of that flip-flop to go high. If the next signal to occur is the interception of cone $C_2$ then a signal appears at input 2 of AND gate 7 causing the output of the AND gate to go high which in turn sets flip-flop 5 and causes the Q output thereof to go high. If the next signal to occur is the interception of cone $C_3$ then a signal appears at input 3 of AND gate 8 causing the output thereof to go high which in turn is fed to detonation means 10 for causing detonation after a predetermined delay. No other order of interception of the cones will cause this output signal to occur.

The signal produced at the time of interception of cone $C_0$ also activates one shot delay network 9 which emits a pulse after a predetermined delay time which is set to be long enough so that the output of gate 8 and possibly detonation would have occurred before the one shot pulse is produced. This pulse is fed to the K inputs of flip-flops 3, 4, and 5 for resetting these flip-flops in the event that the target has passed by and has not caused an output of AND gate 8 and therefore detonation to occur.

Additionally, a circuit similar to the one shown in FIG. 3 but responsive to the order $t_0$, $t_2$, $t_1$ and $t_3$ may be provided for producing an output signal responsive to that order which is indicative of the fact that a target has traversed the missile but is too far away to cause activation of the fuze. Such a signal may be radioed to a ground station if desired.

I wish it to be understood that I do not desire to be limited to the exact details of construction shown and described, for obvious modifications can be made by a person skilled in the art.

I claim:

1. An optical target detection system for a missile comprising, a missile having a missile body, and first, second, third and fourth optical ring sensors mounted around the circumference of said body at different longitudinal positions along its length so that the planes of all of the circles defined by said ring sensors are perpendicular to the missile axis, the active sensing regions of said first and second ring sensors being disposed at an angle of 90° to said missile axis therefore forming first and second cones of 90° with respect to said axis having respective apices at first and second points on said axis at the centers of the circles defined by said first and second rings respectively, said third and fourth ring sensors having sensing regions which are disposed at an angle of other than 90° to said missile axis therefore forming third and fourth cones of other than 90° with respect to said axis, said third and fourth sensors being longitudinally positioned along said axis so that the apices of said third and fourth cones coincide respectively with said first and second apices, said third ring sensor being positioned between said first and second ring sensors and said fourth sensor being longitudinally displaced along said axis from said second sensor the same distance that said third sensor is displaced from said first sensor.

2. The system of claim 1 wherein said first ring sensor is mounted rearwardmost on said missile and said fourth ring sensor is mounted forwardmost.

3. The system of claim 2 wherein said active sensing region of each of said ring sensors comprises a continuous ring of radiant sensitive material.

4. The system of claim 2 wherein said active sensing region of each of said ring sensors comprises a plurality of discrete areas of radiant sensitive material.

5. The system of claim 1 further including means for determining whether or not said first, second, third and fourth cones are intercepted by a target object in a first predetermined order and for generating a signal if they are, and detonation means responsive to the occurrence of said signal for causing detonation of said missile.

6. The system of claim 5 further including means for determining whether said first, second, third and fourth cones are intercepted by said target object in a second predetermined order, which indicates that said target is too far away from said missile for detonation to occur.

* * * * *